United States Patent [19]

Beny et al.

[11] Patent Number: 4,685,894

[45] Date of Patent: Aug. 11, 1987

[54] TOY VEHICLE WITH EJECTABLE FLYWHEEL SEAT AND OPENING GATES

[75] Inventors: Janos Beny, Vista; Toshio Yamasaki, Long Beach, both of Calif.

[73] Assignee: Mattel, Inc., Hawthorne, Calif.

[21] Appl. No.: 882,005

[22] Filed: Jul. 3, 1986

[51] Int. Cl.[4] ..... A63H 17/00; A63H 17/273

[52] U.S. Cl. ..... 446/435; 446/462; 446/470; 446/487; 446/233

[58] Field of Search ..... 446/237, 259, 435, 462, 446/463, 233, 470, 487

[56] References Cited

U.S. PATENT DOCUMENTS

| | | | |
|---|---|---|---|
| Re. 30,299 | 6/1980 | Greenwood . | |
| 2,736,132 | 2/1956 | Murray . | |
| 2,873,553 | 2/1959 | Ullman . | |
| 3,269,055 | 8/1966 | Gordon | 446/259 X |
| 3,628,285 | 12/1971 | Murakami | 446/233 |
| 3,698,129 | 10/1972 | Lemelson . | |
| 3,932,957 | 1/1976 | Morrison et al. . | |
| 3,984,939 | 10/1976 | Wolgamot et al. . | |
| 4,443,967 | 4/1984 | Jones et al. . | |
| 4,463,518 | 8/1984 | Smathers et al. | 446/237 |
| 4,538,999 | 9/1985 | Orlowski | 446/259 |
| 4,556,396 | 12/1985 | Kennedy et al. | 446/23 |

*Primary Examiner*—Mickey Yu

*Attorney, Agent, or Firm*—Ronald M. Goldman; Melvin A. Klein; Daniel F. Sullivan

[57] ABSTRACT

A toy vehicle having front opening gates and an ejectable flywheel seat which may be used as a gyroscopic top or to propel the vehicle. The flywheel seat is removably mounted to the top of the vehicle. A launching level rotatably coupled to the front axle of the vehicle may be used to simultaneously eject the flywheel seat from the toy vehicle and open two gates at the front of the vehicle. Downward movement of the level causes a tiltable box to rotate resulting in the seat being ejected from the vehicle. Movement of the lever also causes a sliding plate to move forward forcing the front gates to open. A flywheel is rotatably mounted inside the flywheel seat. When the flywheel seat is mounted on top of the vehicle, gears coupled to the front axle and mounted inside the tiltable box cause the flywheel to rotate inside the seat as the front wheels of the vehicle rotate. As such, the kinetic energy of the flywheel may be used to propel the toy vehicle forward. The flywheel seat functions like a gyroscopic top after it is ejected from the vehicle.

7 Claims, 8 Drawing Figures

TOY VEHICLE WITH EJECTABLE FLYWHEEL SEAT AND OPENING GATES

BACKGROUND OF THE INVENTION

The present invention relates generally to toy vehicles and, more particularly, to a toy vehicle having front opening gates and an ejectable flywheel seat which may be used as a gyroscopic top or to propel the vehicle.

In the past, numerous flywheel designs have been used for the purpose of propelling toy vehicles such as those disclosed in U.S. Pat. Nos. 4,556,396 issued to Kennedy et al on Dec. 3, 1985; 4,443,967 issued to Jones et al on Apr. 24, 1984; Re. 30,299 reissued to Greenwood on June 10, 1980; 3,984,939 issued to Wolgamot et al on Oct. 12 1976; 3,932,957 issued to Morrison et al on Jan. 20, 1976; 3,698,129 issued to Lemelson on Oct. 17, 1972 and 2,873,553 issued to Ullman on Feb. 17, 1959. A gyroscopic top is shown in U.S. Pat. No. 2,736,132 issued to Murray on Feb. 28, 1956. Finally, U.S. Pat. No. 4,463,518 issued to Smathers et al on Aug. 7, 1984 describes a toy top which may be rotatably mounted inside a toy vehicle. The top is rotated by gears engaging the wheels of the vehicle. A child may eject the top from the toy vheicle by suddenly stopping the wheels of the vehicle from rotating such as when the toy is crashed into a stationary object.

The toy vehicle with the ejectable top described above may be used to eject the top only when the vehicle is brought to a sudden stop. This limits the play options to a child who may wish to keep the toy vehicle moving after the top is ejected. Also, numerous sudden stops may result in damage to the gears of the toy vehicle.

These problems would be eliminated by a seat with a built-in flywheel which is releasably mounted on a toy vehicle and functions as both a seat for a figure toy and a gyroscopic top capable of being ejected from the vehicle by a launching lever. The flywheel could be used to propel the toy vehicle forward so long as the seat remains mounted on the vehicle. Additional play options would be presented if the front of the toy vehicle opened as the seat or top is ejected by the launching lever. Accordingly, there is a need in the toy manufacturing arts for a toy vehicle having front opening gates and an ejectable flywheel seat which may be used to propel the vehicle or as a gyroscopic top after it is ejected by a launching lever.

SUMMARY OF THE INVENTION

It is an object of this invention to provide a toy vehicle having an ejectable flywheel seat which may be used to propel the vehicle or as a gyroscopic top.

It is another object of this invention to provide a toy vehicle having a flywheel seat which may be ejected from the vehicle by a launching lever.

It is still another object of this invention to provide a toy vehicle having opening gates which open at the front of the vehicle when the flywheel seat is ejected from the vehicle.

These and other objects and advantages are attained by a toy vehicle having front opening gates and an ejectable flywheel seat which may be used as a gyroscopic top or to propel the vehicle. The flywheel seat is removably mounted to the top of the vehicle. A launching level rotatably coupled to the front axle of the vehicle may be used to simultaneously eject the flywheel seat from the toy vehicle and open two gates at the front of the vehicle. Downward movement of the level causes a tiltable box to rotate resulting in the seat being ejected from the vehicle. Movement of the lever also causes a sliding plate to move forward forcing the front gates to open. A flywheel is rotatably mounted inside the flywheel seat. When the flywheel seat is mounted on top of the vehicle, gears coupled to the front axle and mounted inside the tiltable box cause the flywheel to rotate inside the seat as the front wheels of the vehicle rotate. As such, the kinetic energy of the flywheel may be used to propel the toy vehicle forward. The flywheel seat functions like a gyroscopic top after it is ejected from the vehicle.

The various features of the present invention will be best understood, together with further objects and advantages by reference to the following description of the preferred embodiment taken in connection with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commerical environment, although it should be understood that various modifications can be accomplished within the parameters of the present invention.

Figure 1:
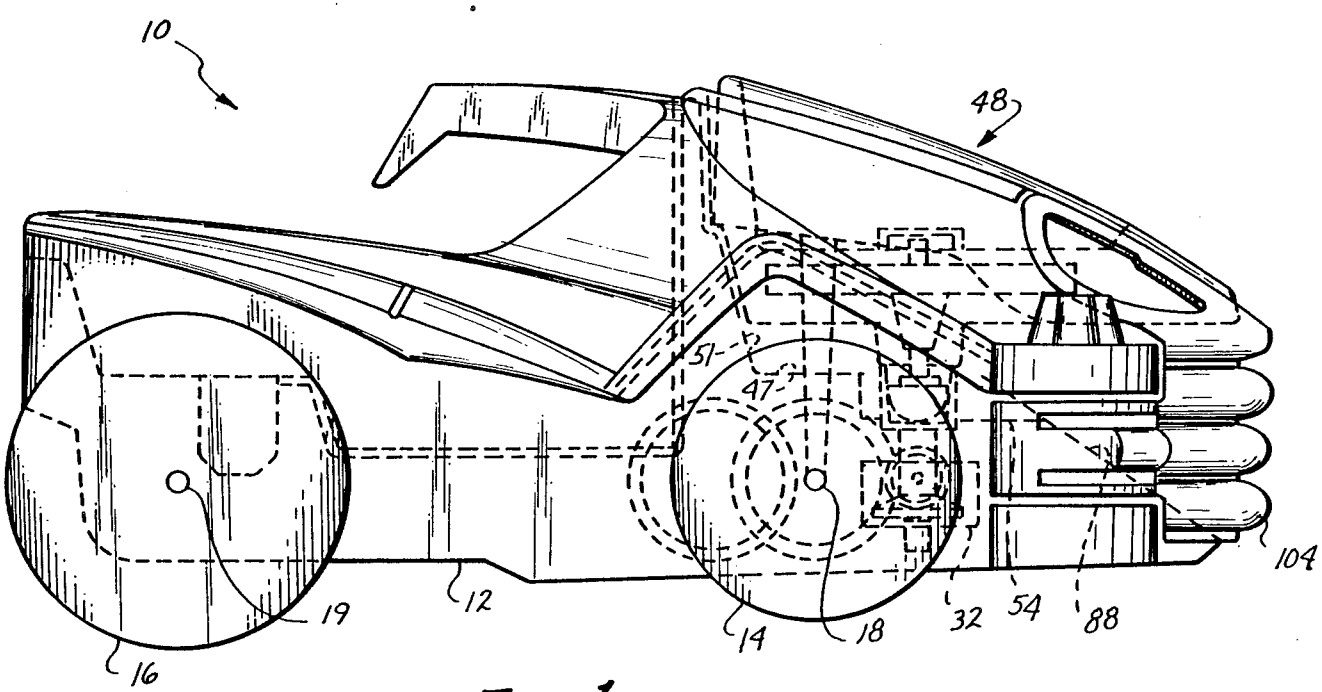
FIG. 1 is a side elevational view of the preferred embodiment of the toy vehcle of the present invention.
Figure 2:
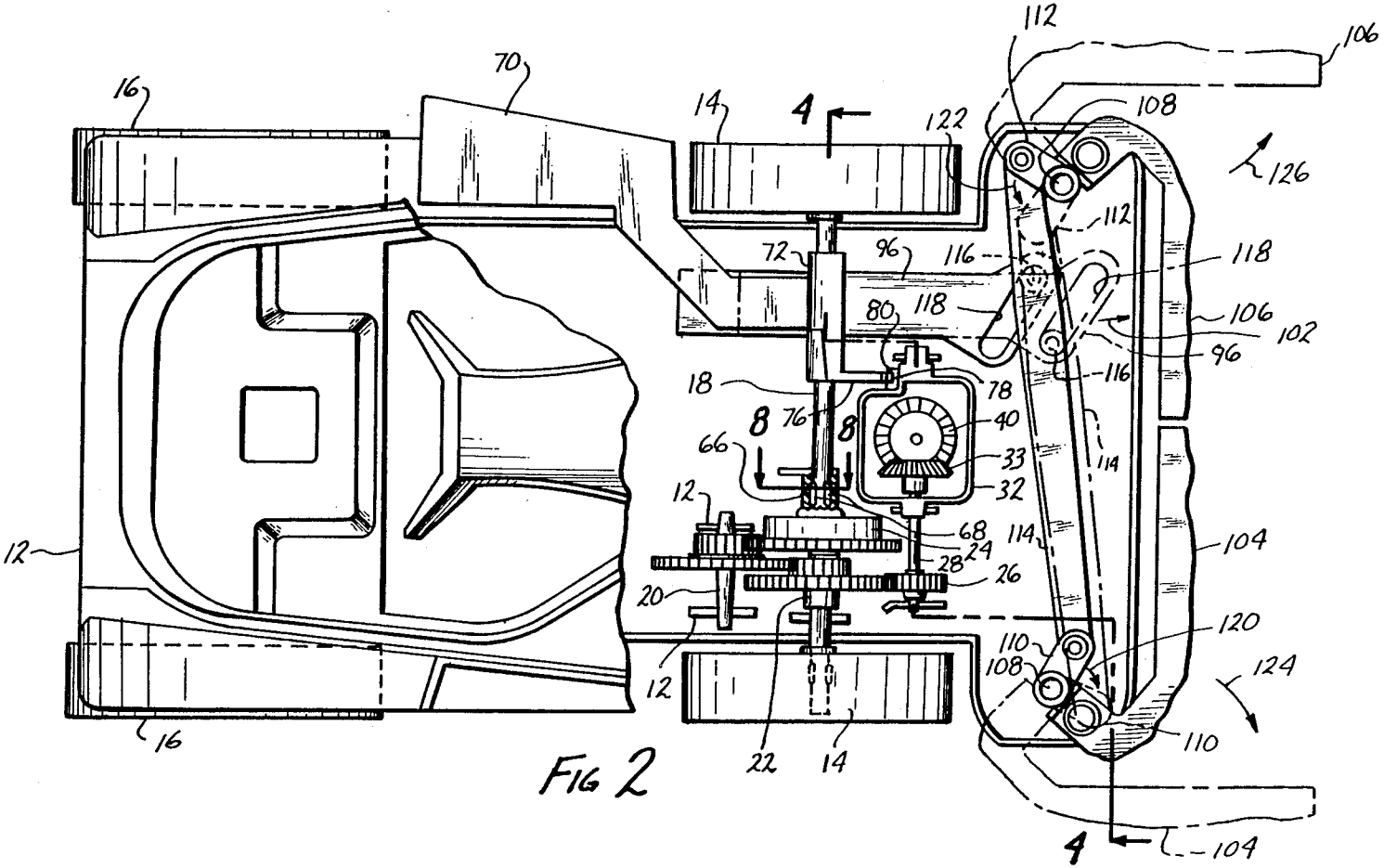
FIG. 2 is a top plan view of the toy vehicle of FIG. 1 with part of the vehicle broken away to show gears used for the vehicle and how a launching lever may be used to open two gates at the front of the vehicle.
Figure 3:
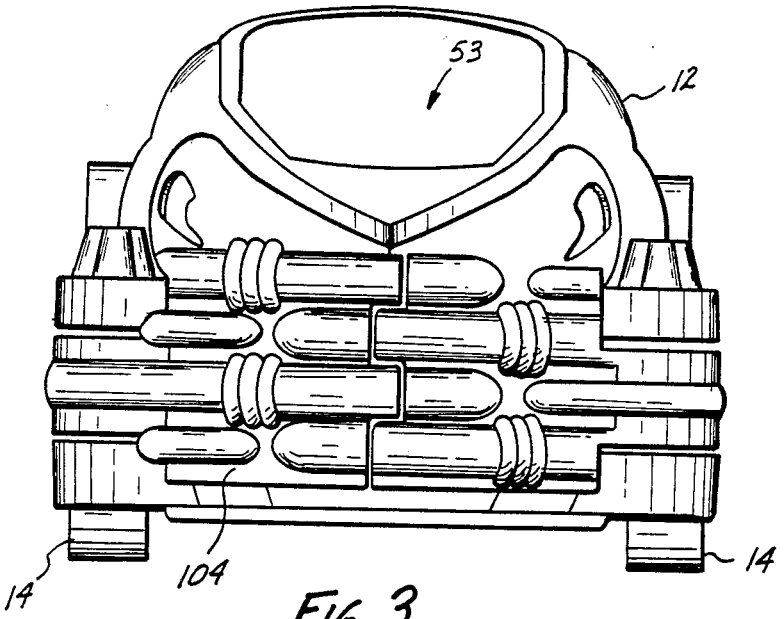
FIG. 3 is a front elevational view of the toy vehicle of FIG. 1.

Referring now to the drawings and particularly to FIGS. 1 through 3, a preferred embodiment of the toy vehicle 10 of the present invention is disclosed. The toy vehicle 10 has a body portion 12 and front and rear wheels 14 and 16, respectively. The wheels 14 and 16 are mounted on axles 18 and 19, respectively, which rotatably engage the body portion 12.

The gear mechanisms used for the toy vehicle 10 are shown in FIG. 2. A gear 20 is rotatably mounted on the body portion 12. Gear 20 meshes with gear 22 rotatably engaged to axle 18 and gear 24 coupled to axle 18 as illustrated in FIG. 2. As a result, rotation of axle 18 causes gear 24 to drive gear 20 which, in turn, drives gear 22.

Figure 4:
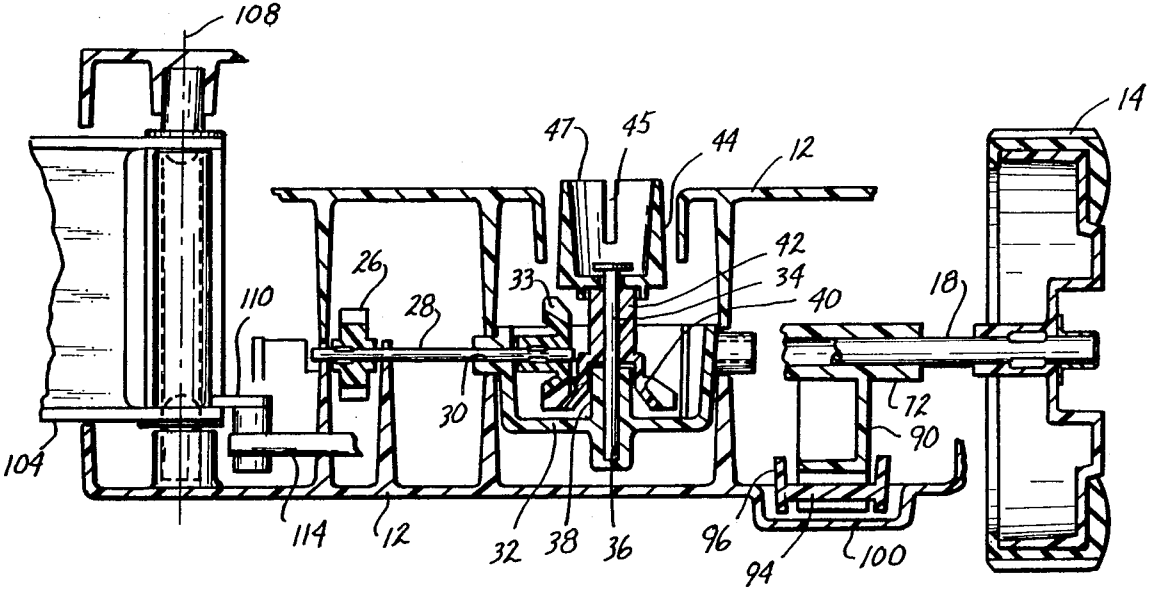
FIG. 4 is a partial cross-sectional view taken in the direction of arrows 4—4 shown in FIG. 2.

As gear 22 rotates on axle 18, it meshes with and drives gear 26 coupled to a shaft 28 preferably by keys. One end of shaft 28 is rotatably mounted to the body portion 12 as shown in FIGS. 2 and 4. The other end of the shaft 28 passes through an aperture 30 in a tiltable box 32 rotatably mounted to the body portion 12 (see FIG. 4). A bevel gear 33 is coupled to the end of shaft 28 which passes through aperture 30. As shown in FIG. 4, a shaft 34 mounted to the tiltable box 32 is press fit into aperture 36 in a generally cylindrically-shaped portion 38 of the box. A bevel gear 40 meshing with gear 33 is rotatably mounted to shaft 34 inside box 32. The shaft 34 rotatably engages a generally cylindrically-shaped extension 42 of the gear 40. A flexible portion 44 is also attached to extension 42. Portion 44 preferably has a plurality of slits 45 therein which form a number of flexible figures 47 used to releasably hold the bottom portion 46 of a flywheel seat 48 as explained below (see FIGS. 1 and 6).

Rotation of the front wheels 14 causes gears 20, 22, 24 and 26 to rotatably engage each other resulting in rotation of shaft 28. As shaft 28 rotates, bevel gears 33 and 40 also rotate causing flexible portion 44 to spin about the axis of shaft 34.

Figure 6:
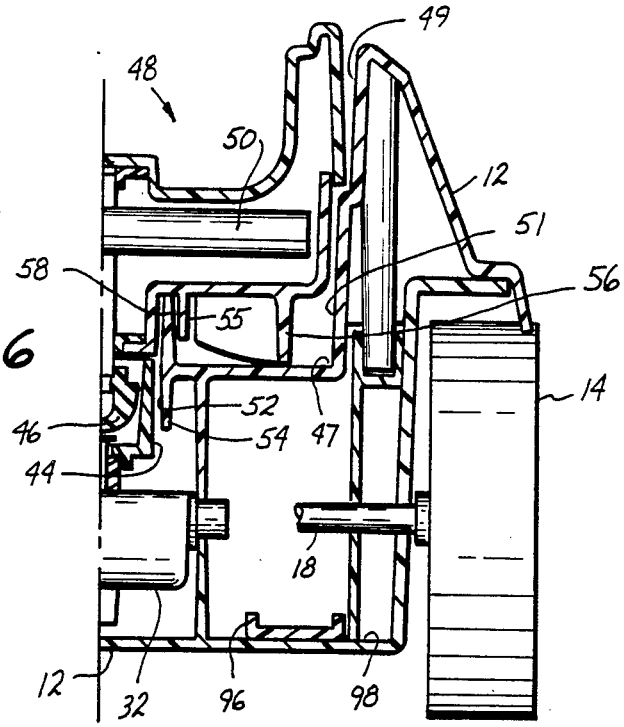
FIG. 6 is a partial cross-sectional view of one-half of the toy vehicle of FIG. 1 showing how the flywheel seat is releasably mounted on the vehicle.

The flywheel seat 48 is removably mounted on top of the body portion 12 as shown in FIGS. 1 and 6. The seat 48 rests on top of surface 47 and inside a cavity 53 (see FIG. 3) formed by surfaces 49 and 51. A flywheel 50 is rotatably mounted inside the seat 48. The bottom portion 46 of the seat 48 rotates with the flywheel 50 and fits through an aperture 52 formed by downward extensions 54 of the body portion 12 (see FIGS. 1 and 6). A child may mount the flywheel seat 48 on top of the toy vheicle 10 by pushing the bottom portion 46 into aperture 52 until it releasably engages flexible portion 44. When in this position, flanges 56 extending from the bottom of the seat 48 will be resting on surface 47. Also, note that portions 58 extending upward from the body portion 12 help to support the mounted seat 48. As explained below, downward extensions 55 from the flywheel seat 48 help to guide the seat along portions 58 after ejection of the seat.

When the flywheel seat 48 is mounted on top of the vehicle 10 as previously described, the flywheel 50 is free to rotate inside the seat about a verticl spin axis in response to rotation of the bottom portion 46 while the seat itself remains stationary. Since bottom portion 46 is releasably engaged to flexible portion 44 by the flexible figures 47, rotation of the wheels 14 will cause portions 44 and 46 to rotate at the same time resulting in spinning of the flywheel 50 about its vertical spin axis. As a result, the kinetic energy of the flywheel 50 may be used to propel the toy vehicle 10 along its intended path so long as the seat 48 remains mounted on top of the vehicle.

Figure 8:
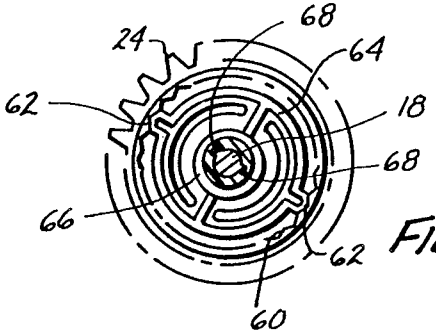
FIG. 8 is an enlarged detailed view of one of the gears taken in the direction of arrows 8—8 shown in FIG. 2.

Gear 24 has a built-in two-way clutch as shown in FIG. 8. The gear 24 has a plurality of inner teeth 60 which operably engage pointed extensions 62 attached to a flexible outer ring 64 supported by hub 66. Axle 18 passes through apertures in the hub 66 and gear 24. Keys 68 on the axle 18 engage the keyed portion of the aperture in the hub 66 so that rotation of the axle 18 causes the hub 66 and flexible outer ring 64 to rotate. Since extensions 62 engage teeth 60, the gear 24 rotates with the ring 64 and hub 66. However, extensions 62 will disengage from teeth 60 allowing the axle 18 to freely rotate within the aperture in the gear 24 when excessive torsion is applied to the axle 18. This helps to prevent damage to the gears when a child improperly uses the toy.

Figure 5:
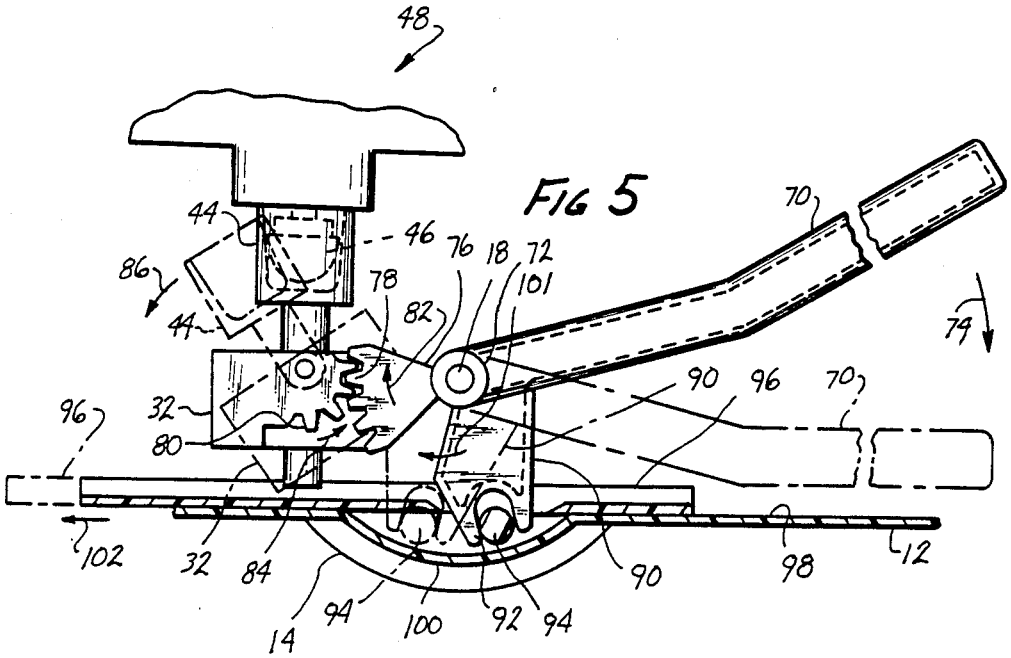
FIG. 5 is an enlarged detained view showing how the launching lever may be used to eject a flywheel seat.

A launching lever 70 is pivotally rotated to axle 18 by hub 72 is such a way that the lever may be rotated in the direction of the arrow 74 shown in FIG. 5. The hub 72 has a flat member 76 extending radially outward therefrom with teeth 78 attached thereto. Teeth 78 mesh with teeth 80 attached to tiltable box 32. As such, when lever 70 is rotated downward in the direction of arrow 74, teeth 78 and 80 rotate in accordance with arrows 82 and 84, respectively, as illustrated in FIG. 5. This rotational movement of the teeth 78 and 80 cuses the tiltable box 32 to tilt or rotate in the direction of arrow 86 as the box rotates about an axis coinciding with the longitudinal axis of shaft 28 (see FIG. 4).

The launching lever 78 may be used to eject the flywheel seat 48 by simply pushing the lever in the direction of arrow 74 and tilting box 32 in the direction of arrow 86. If the lever 78 is pushed hard enough, the tilting movement of the box 32 will cause the bottom portion 46 of the seat 48 to disengage from the flexible portion 44 and the seat to be thrown forward. Apeture 52 (see FIG. 6) provides sufficient room to throw the seat 48 forward. The seat 48 will then slide down slanted surface 88 (see FIG. 1) as it is guided by extensions 55 and portions 58 (see FIG. 6). If the flywheel 50 has been rotating prior to ejection of the seat 48, then the seat will function like a gyroscopic top as it slides down surface 88.

Lever 78 also has a downwardly extending portion 90 with fork-shaped extensions 92 which engage a member 94 attached to a sliding plate 96 as shown in FIG. 5. The plate 96 slidably engages top surface 98 of the body portion 12 (see FIG. 6). A downwardly extending portion 100 (see FIGS. 4 and 5) of the body portion 12 provides room for movement of member 94 and extensions 92 in response to movement of lever 70. As illustrated in FIG. 5, downward movement of the launching lever 70 in the direction of arrow 74 causes extensions 92 to move member 94 in the direction of arrow 101 as portion 90 pivots about the longitudinal axis of hub 72. Movement of member 94 in the direction of arrow 101 forces plate 96 to slide forward in the direction of arrow 102 (see FIGS. 2 and 5). As explained below, two front gates 104 and 106 open as plate 96 moves forward.

Front gates 104 and 106 are pivotally mounted to the body portion 12 at vertical axes 108 (see FIGS. 2 and 4). Links 110 and 112 each have one end thereof attached to gates 104 and 106, respectively (see FIG. 4). The other end of each of links 110 and 112 is pivotally engaged to an elongated member 114 as shown in FIGS. 2 and 4. The elongated member 114 has a downwardly extending pin 116 which operably engages an elongated slot 118 in sliding plate 96. As illustrated in FIG. 2, movement of plate 96 in the direction of arrow 102 due to downward movement of lever 70 causes pin 116 to slide down slot 118 until it reaches the end of the slot. As the pin 116 slides down the slot 118, links 110 and 112 are forced to rotate about axes 108 in the directions of arrows 122 and 120, respectively. Rotation of the links 110 and 112 causes gates 104 and 106 to also rotate about axes 108 as illustrated by arrows 124 and 126 until they reach open positions as shown in FIG. 2.

Figure 7:
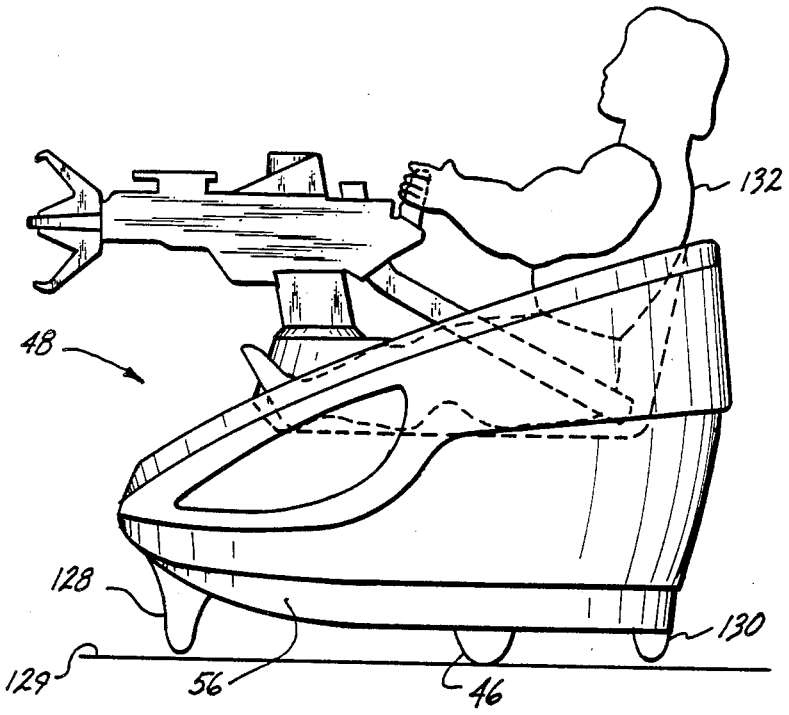
FIG. 7 is a side elevational view of the flywheel seat shown resting on a supporting surface.

As explained above, downward movement of the launching lever 70 simultaneously causes the flywheel seat 48 to be ejected from the toy vehicle 10 and the front gates 104 and 106 to open. Thus, a child may push the lever 70 down causing the gates 104 and 106 to open as the seat 48 is ejected from the flexible portion 44 and guided down slanted surface 88 at the front of the toy vehicle 10 by extensions 55 onto a playing surface 129 supporting the vehicle. If the flywheel 50 is spinning when the seat 48 is ejected, then the seat 48 will act as a gyroscopic top as bottom portion 46 spins on top of supporting surface 129 as shown in FIG. 7. Supports 128 and 130 may be used to help balance or support the seat 48 as shown. Note that a child may use the flywheel seat 48 in conjunction with a figure toy 132 as shown in FIG. 7.

The front gates 104 and 106 may be closed by simply moving lever 70 in an upward direction opposite to arrow 74 (see FIG. 5). Upward movement of lever 70 will also cause tiltable box 32 to return to its original vertical position. The flywheel seat 48 may then be mounted to the top of the vehicle 10.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A toy vehicle, comprising:

a body portion;

front and rear wheels rotatably mounted on said body portion, said front wheels being attached to an axle rotatably engaged to said body portion;

a tiltable box rotatably mounted on said body portion, said tiltable box having a shaft exiting through an aperture therein;

a flywheel seat removably mounted to the top of said body portion and removably engaging said tiltable box, said flywheel seat including a flywheel rotatably mounted therein;

gear means for operatively coupling said axle to said shaft;

two front gates rotatably mounted to said body portion; and lever means for rotating said tiltable box and opening said front gates.

2. The toy vehicle of claim 1 further comprising clutch means for engaging and disengaging said gear means.

3. The toy vehicle of claim 1 wherein said gear means comprises:

a first gear coupled to said axle;

a second gear rotatably mounted on said body portion, said second gear meshing with said first gear;

a third gear rotatably mounted on said axle, said third gear meshing with said second gear; and a fourth gear coupled to said shaft, said fourth gear meshing with said third gear.

4. The toy vehicle of claim 1 wherein said tiltable box includes:

a shaft mounted to said box;

a first bevel gear rotatably mounted to said shaft mounted to said box;

a second bevel gear coupled to said shaft exiting said aperture in said box, said second bevel gear meshing with said first bevel gear;

a flexible portion attached to an extension of said first bevel gear, said flexible portion removably engaging a bottom portion of said flywheel seat; and gear teeth attached to said box.

5. The toy vehicle of claim 4 wherein said lever means comprises:

a launching lever rotatably coupled to said axle;

a flat member attached to said lever having gear teeth attached thereto, said gear teeth of said flat member meshing with said gear teeth of said tiltable box;

a downwardly extending portion attached to said lever having fork-shaped extensions;

a plate slidably engaging the bottom of said body portion, said plate having an elongated slot and a member attached thereto operably engaging said fork-shaped extensions;

an elongated member having a pin attached thereto operably engaging said elongated slot; and two links, each of said links having one end thereof pivotally coupled to one end of said elongated member and the other end thereof attached to one of said front gates.

6. A toy vehicle, comprising:

a body portion;

front and rear wheels rotatably mounted on said body portion, said front wheels being attached to an axle rotatably engaged to said body portion;

a flywheel seat removably mounted' to the top of said body portion, said flywheel seat including a flywheel rotatably mounted therein;

tiltable box means rotatably mounted on said body portion for ejecting said flywheel seat and releasably engaging a bottom portion of said flywheel seat so that rotation of said front wheels causes said flywheel to rotate;

a gear assembly operably coupled to said axle and said tiltable box means;

two front gates rotatably mounted to said body portion; and lever means for rotating said tiltable box means and opening said front gates.

7. The toy vehicle of claim 6 further comprising clutch means for engaging and disengaging said gear assembly.

* * * * *